US011051587B2

(12) United States Patent
Lin

(10) Patent No.: US 11,051,587 B2
(45) Date of Patent: Jul. 6, 2021

(54) MULTICOLORED AGLET AND METHOD FOR PRODUCING THE SAME

(71) Applicant: CHEN TAI LACES CO., LTD., Hemei Township (TW)

(72) Inventor: Wu-Tao Lin, Hemei Township (TW)

(73) Assignee: CHEN TAI LACES CO., LTD., Hemei Township (JP)

( * ) Notice: Subject to any disclaimer, the term of this patent is extended or adjusted under 35 U.S.C. 154(b) by 150 days.

(21) Appl. No.: 16/135,351

(22) Filed: Sep. 19, 2018

(65) Prior Publication Data

US 2020/0085146 A1 Mar. 19, 2020

(51) Int. Cl.
*A43C 9/04* (2006.01)
*A43C 9/02* (2006.01)

(52) U.S. Cl.
CPC . *A43C 9/04* (2013.01); *A43C 9/02* (2013.01)

(58) Field of Classification Search
CPC ..... A43C 9/04; A43C 9/02; Y10T 24/3789; Y10T 24/3726
See application file for complete search history.

(56) References Cited

U.S. PATENT DOCUMENTS 1,691,451 A * 11/1928 Uellendahl ..... A43C 9/04 24/715.4
1,730,809 A * 10/1929 Dennis ..... A43C 9/04 24/715.4
3,581,353 A * 6/1971 Sonntag ..... A43C 9/02 24/715.4
6,119,591 A * 9/2000 Chen ..... A43C 9/04 101/35
6,167,599 B1 * 1/2001 Chen ..... A43B 1/0036 24/712
6,267,052 B1 * 7/2001 Hill ..... B41M 1/18 101/211
6,790,525 B2 * 9/2004 Takeuchi ..... B44C 5/04 428/339
2005/0125971 A1 * 6/2005 Lee ..... A43C 9/00 24/712
2007/0204443 A1 * 9/2007 Cheng ..... A43B 3/0078 24/713.1
2009/0022434 A1 * 1/2009 Chiba ..... B01D 53/261 383/109
2010/0205791 A1 * 8/2010 Cheng ..... A43B 3/0078 24/715.4
2012/0144632 A1 * 6/2012 Cheng ..... A43C 9/04 24/715.4
2017/0295887 A1 * 10/2017 Torres ..... A43C 1/02
2017/0341416 A1 * 11/2017 Yang ..... B41J 2/2117

* cited by examiner

*Primary Examiner* — Robert Sandy
*Assistant Examiner* — Rowland Do
(74) *Attorney, Agent, or Firm* — Tracy M Heims; Apex Juris pllc.

(57) ABSTRACT

A multicolored aglet connected to a shoelace has a unit slice, a pattern layer, and a white background layer. The unit slice is formed into two aglet bodies that are respectively sheathed on two ends of the shoelace, and has a mounting portion. The mounting portion of the unit slice is stuck to an outer side of the unit slice. The pattern layer is printed on and covers the inner side of the unit slice excluding the mounting portion, and is located between the unit slice and the shoelace. The white background layer is printed on the pattern layer and is located between the pattern layer and the shoelace. A method for producing the multicolored aglet is also provided.

4 Claims, 8 Drawing Sheets

MULTICOLORED AGLET AND METHOD FOR PRODUCING THE SAME

BACKGROUND OF THE INVENTION

1. Field of the Invention

The present invention relates to a shoelace aglet and a method for producing the shoelace aglet, and more particularly to a multicolored shoelace aglet and a method for producing the same.

2. Description of Related Art

A conventional shoelace has two aglets respectively sheathed on two ends of the shoelace. The aglets are made of plastic or metal to keep fibers of the shoelace from unraveling, since unraveling fibers may shorten lifetime of the conventional shoelace and cause inconvenience to a user tying the conventional shoelace.

To increase visual appeal, conventional colored aglets are produced by at least two steps: printing designed patterns on a plastic slice through screen printing, and forming the plastics slice into an aglet sheathed on an end of a shoelace.

However, the conventional colored aglets have the following shortcomings.

1. A manufacturer has to make meshes for a designed pattern before processing screen printing. To print a pattern of complicated sketches and multiple colors, the manufacturer needs to spend more time and money on preparing suitable meshes.

2. Due to the defect of the screen printing mentioned above, customization is difficult; otherwise prices of the conventional colored aglets will be expensive.

3. Pores of the meshes are too large for a pattern to be printed in color gradients. On the contrary, the pattern will look like a color mosaic after the screen printing. Also, when a large amount of meshes are applied to print a pattern, precise printing of the pattern is unlikely to be achieved due to excessive procedures.

4. Ink of the screen printing contains volatile organic solutions. Besides, after the printing process, the meshes have to be washed with other organic solutions. Therefore, the liquid waste produced throughout the screen printing is pollutional and harmful to the environment.

5. After printed, the plastic slices have to be settled for a while so that the volatile solution may vaporize and the patterns are then fixed on the plastic slices. Consequently, a large space for such a process becomes indispensable, which makes the screen printing space consuming.

6. During the process of forming aglets, another solution included in the process may dissolve the ink and thereby ruin the pattern on the plastic slices.

To overcome such shortcomings of the conventional colored aglets, the present invention provides a multicolored shoelace aglet and a method for producing the same.

SUMMARY OF THE INVENTION

A primary objective of the present invention is to provide a multicolored aglet and a method for producing the same, in order to overcome the aforementioned shortcomings of the prior art.

A method for producing a multicolored aglet has a plastic slitting step, a printing step, and an aglet forming step. The plastic slitting step is to slit a transparent plastic material to obtain a plastic slice according to a preset width. The printing step is using digital printing ink to print multiple pattern layers on an inner side of the plastic slice at spaced intervals, and to print a respective white background layer on each one of the multiple pattern layers. The aglet forming process has two steps. Firstly, cut the plastic slice into multiple unit slices, so that each one of the multiple unit slices has a respective one of the pattern layers and a respective one of the white background layers. Secondly, form each one of the multiple unit slices into two aglet bodies that are respectively sheathed on two ends of a shoelace, wherein each unit slice has one said pattern layer and one said white background layer located between the unit slice and the shoelace.

A roll for producing a multicolored aglet has a plastic slice, multiple pattern layers, and multiple white background layers. The plastic slice has an inner side. The multiple pattern layers are printed on the inner side of the plastic slice at spaced intervals. Each one of the multiple white background layers is printed on a respective one of the multiple pattern layers.

A multicolored aglet that is connected to a shoelace has a unit slice, a pattern layer, and a white background layer. The unit slice is formed into two aglet bodies that are respectively sheathed on two ends of the shoelace, and has a mounting portion. The mounting portion of the unit slice is stuck to an outer side of the unit slice. The pattern layer is printed on and covers the inner side of the unit slice excluding the mounting portion, and is located between the unit slice and the shoelace. The white background layer is printed on the pattern layer and is located between the pattern layer and the shoelace.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
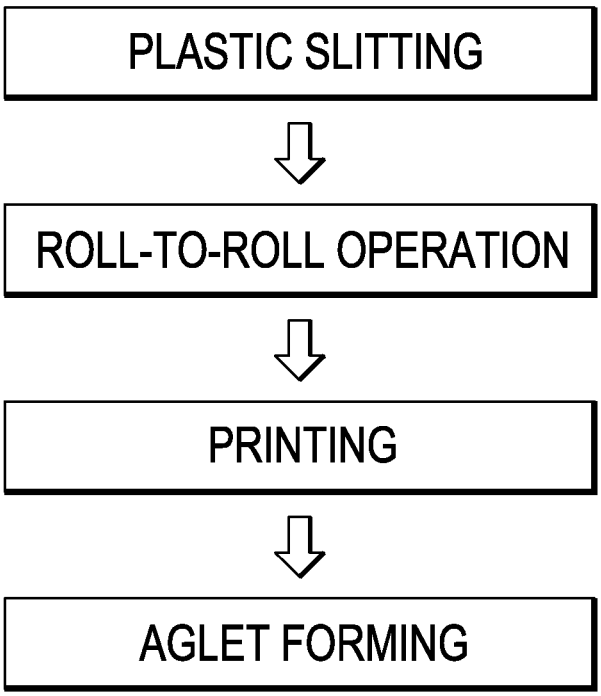
FIG. 1 is an operational flow chart of a method for producing a multicolored aglet in accordance with the present invention.
Figure 5:
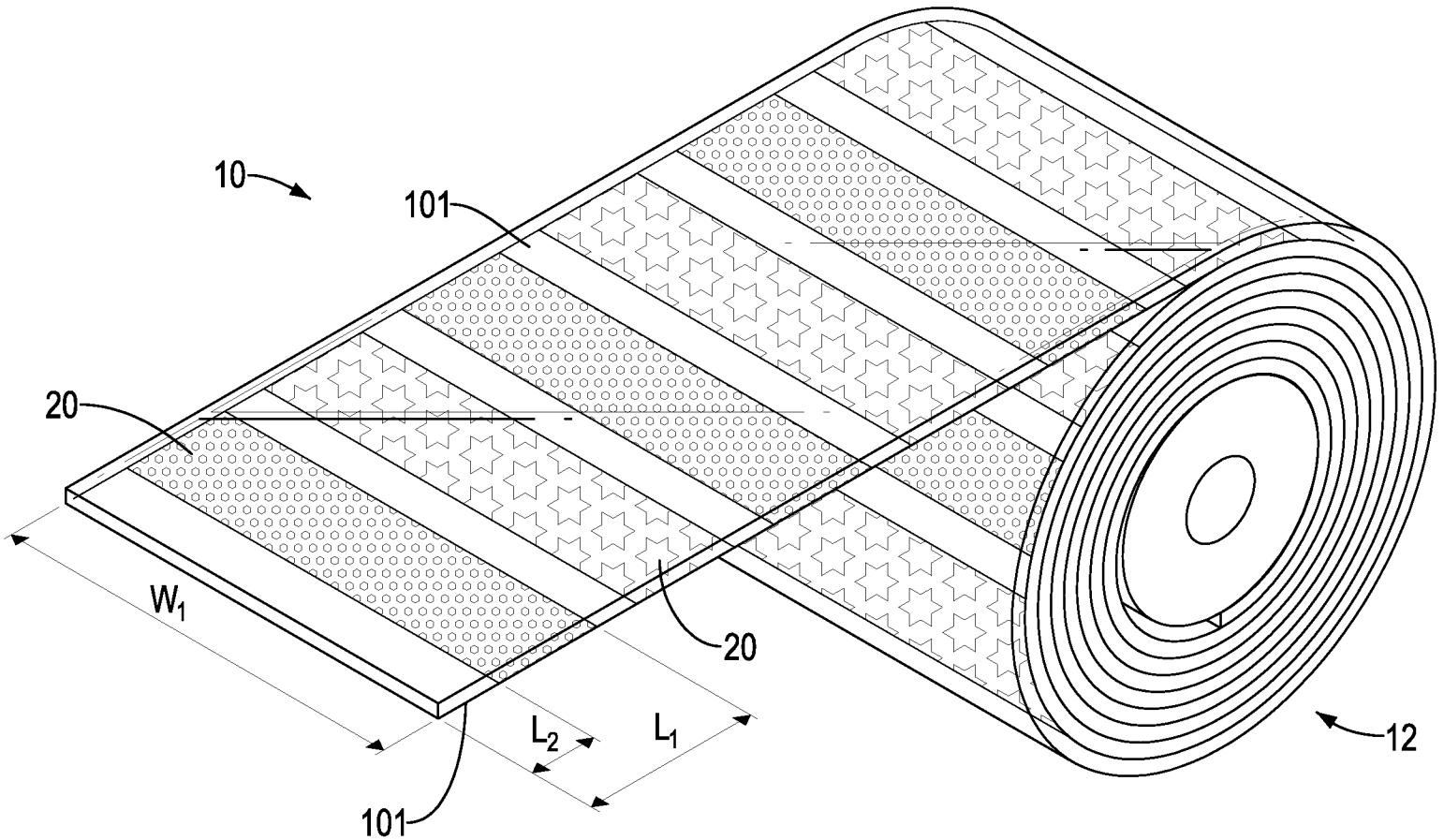
FIG. 5 is a perspective view of a post-printing roll for producing multicolored aglets in accordance with the present invention.
Figure 7:
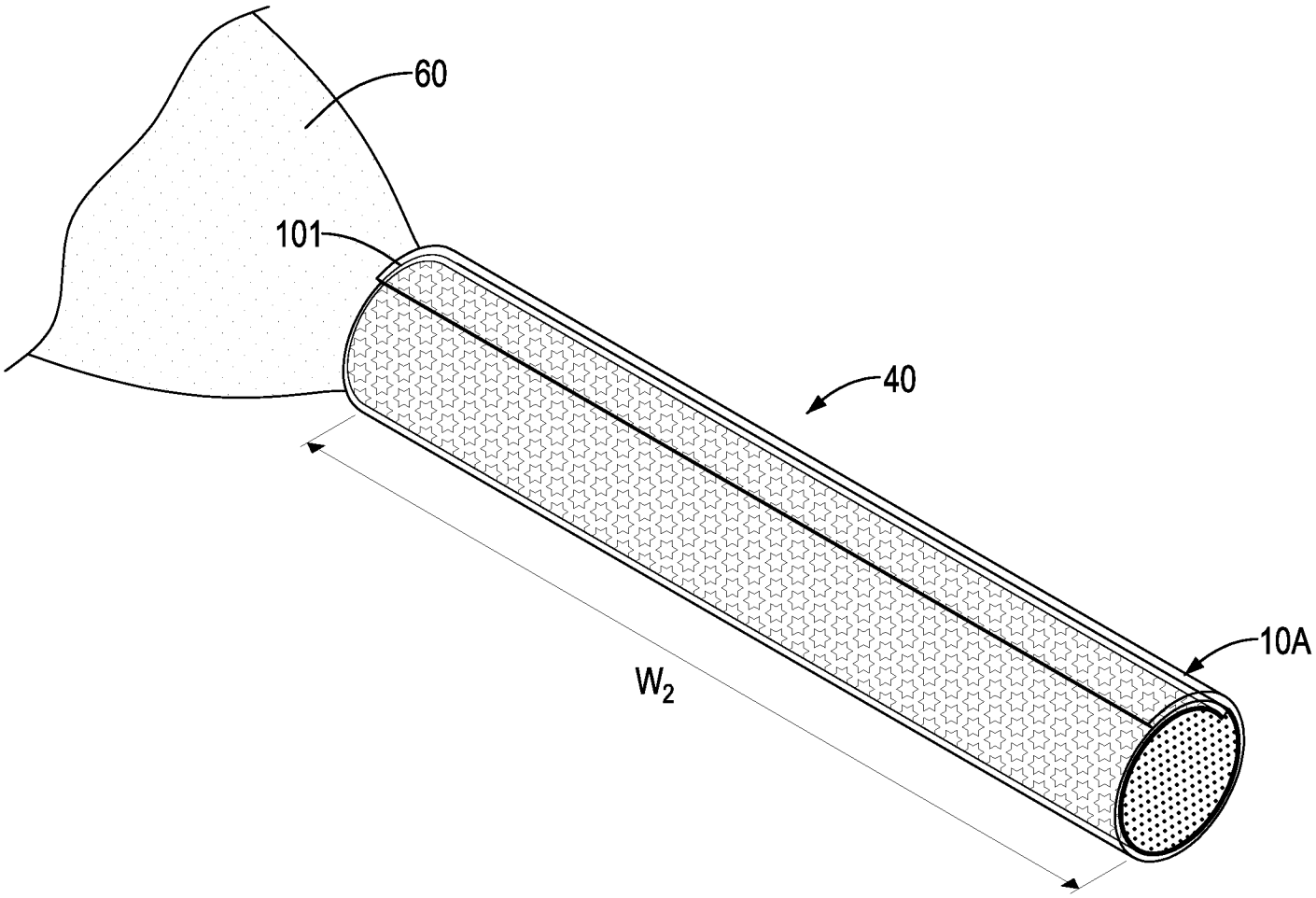
FIG. 7 is an enlarged perspective view of the multicolored aglet in FIG. 6.

With reference to FIG. 1, a method for producing a multicolored aglet comprises the following steps:

1. Plastic slitting step: set up a slice width W1 according to demand by a user, and slit a transparent plastic material into a plastic slice 10 of the slice width W1. As shown in FIGS. 5 and 7, the slice width W1 is twice of an aglet width W2, so that the plastic slice 10 may be fully utilized. In the embodiment in accordance with the present invention, the plastic slice 10 is made of cellulose acetate. The slice width W1 may be 20 to 60 millimeters (mm) or 30 to 50 mm, i.e., the aglet width W2 may be 10 to 30 mm or 5 to 25 mm.

2. Roll-to-roll operation step: with reference to FIG. 2, put the slit plastic slice 10 on a printer 50 and finish a roll-to-roll positioning, so that the plastic slice 10 forms a pre-printing roll 11 and a post-printing roll 12. Every part of the plastic slice 10 will move in series from a position of the pre-printing roll 11 to a position of the post-printing roll 12. An inner side of every part of the plastic slice 10 at the position of the pre-printing roll 11 is oriented upwardly as the part passes through the printer 50, and becomes rolled-up inwardly once again at the position of the post-printing roll 12 after being printed.

3. Printing step: with reference to FIGS. 2 and 3, after finishing the roll-to-roll operation, use the printer 50 with digital printing ink to firstly print out multiple pattern layers 20, and then to print multiple white background layers 30 on the multiple pattern layers 20, respectively.

The multiple pattern layers 20 are printed on the inner side of the plastic slice 10 at spaced intervals, and each one of the pattern layers 20 may have a respective pattern and a respective color. Each one of the white background layers 30 is printed on and covers a corresponding pattern layer 20 under precise location.

Consequently, each one of the pattern layers 20 is covered between the plastic slice 10 and the corresponding white background layer 30. The user may see the patterns of the pattern layers 20 through the plastic slice 10 in correct colors because the background is white. As a result, the pattern projects a positive aesthetic in luminosity and color.

Figure 4:
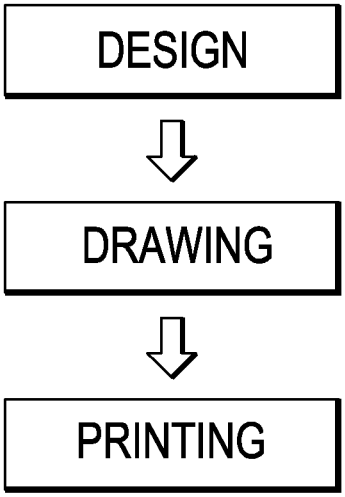
FIG. 4 is an operational flow chart of the printing step of the method for producing a multicolored aglet in FIG. 2.

With reference to FIG. 4, the patterns of the pattern layers 20 are designed and drawn on a computer, before printed on the plastic slice 10 by the printer 50. Moreover, the multiple pattern layers 20 are equally spaced at intervals of an interval length L2, and each one of the pattern layers 20 and the corresponding white background layer 30 have the same length. The plastic slice 10 therefore has multiple mounting portions 101. Each one of the mounting portions 101 is formed between two adjacent said pattern layers 20, so a length of each one of the mounting portions 101 is the interval length L2.

4. Aglet forming: with reference to FIGS. 5 to 7, the post-printing roll 12 has a width, which is the slice width W1, and each one of the pattern layers 20 along with a corresponding one of the two adjacent mounting portions 101 has a total length, which is an aglet length L1. The post-printing roll 12 may be used to produce multicolored aglets.

Cut the plastic slice 10 into multiple unit slices 10A, wherein each one of the unit slices 10A correspondingly has a respective pattern layer 20, a respective white background layer 30, and a respective mounting portion 101. The unit slice 10A is cut in a length, which is the aglet length L1. Then each one of the unit slices 10A may be formed into a multicolored aglet, which comprises two aglet bodies 40. The two aglet bodies 40 are sheathed on two ends of a shoelace 60, respectively. The corresponding pattern layer 20 and the corresponding white background layer 30 therein are wrapped by the unit slice 10A, and are located inside the aglet bodies 40. A width of each one of the aglet bodies 40 is thus the aglet width W2, that is, half of the slice width W1. How the unit slices 10A are formed onto the shoelace 60 is known by persons of ordinary skill in the art, so a detailed description thereof is omitted.

Figure 8:
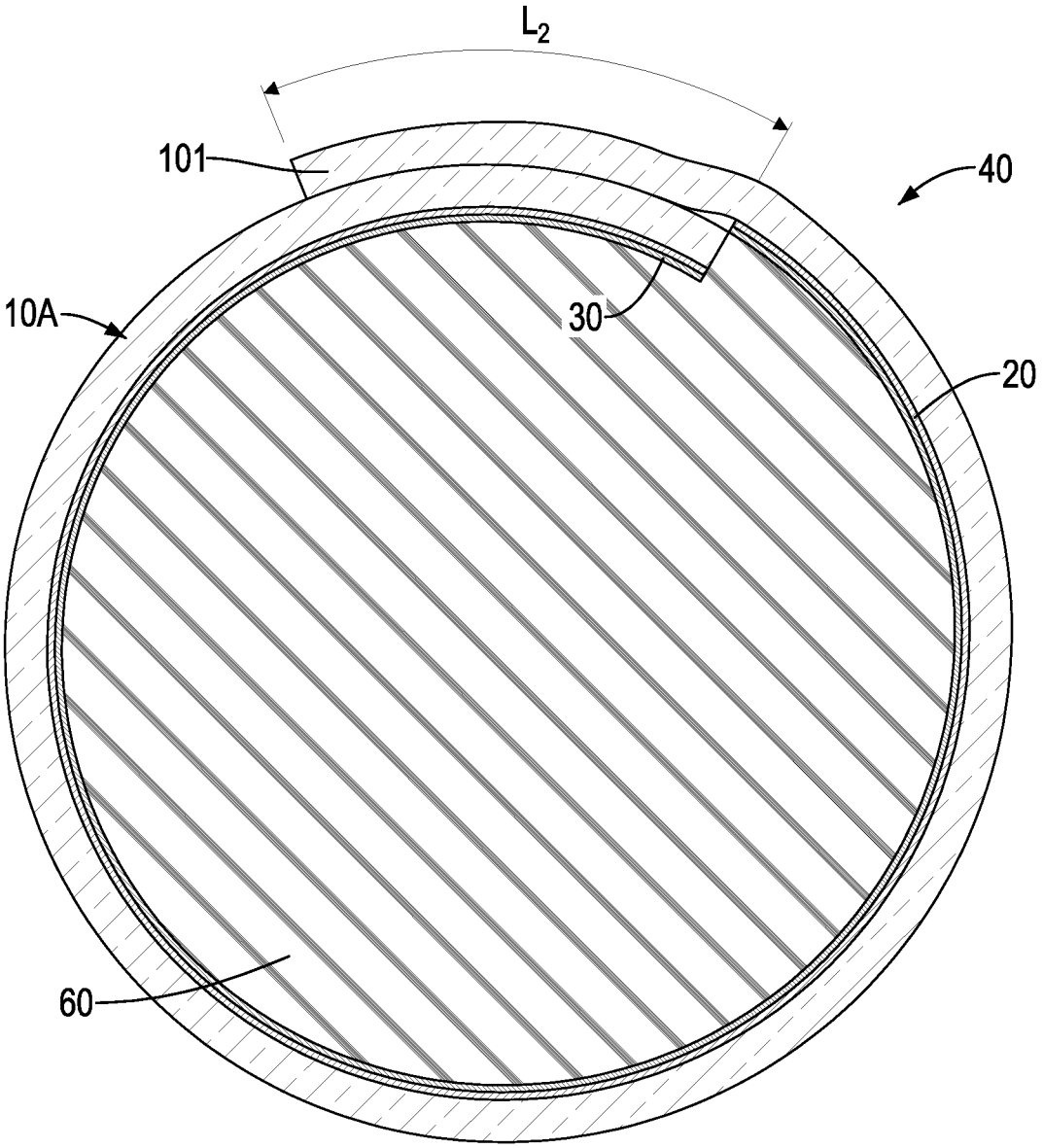
FIG. 8 is a cross sectional side view of the multicolored aglet in FIG. 6.

Furthermore, with reference to FIG. 8, an inner side of the mounting portion 101 of the unit slice 10A is smeared with an organic solution to partially dissolve the mounting portion 101 and to stick the mounting portion 101 to an outer side of the aglet bodies 40. After the organic solution evaporates, the dissolved part will once again solidify, and the aglet bodies 40 are thereby shaped. In the present invention, the organic solution is acetone.

Figure 3:
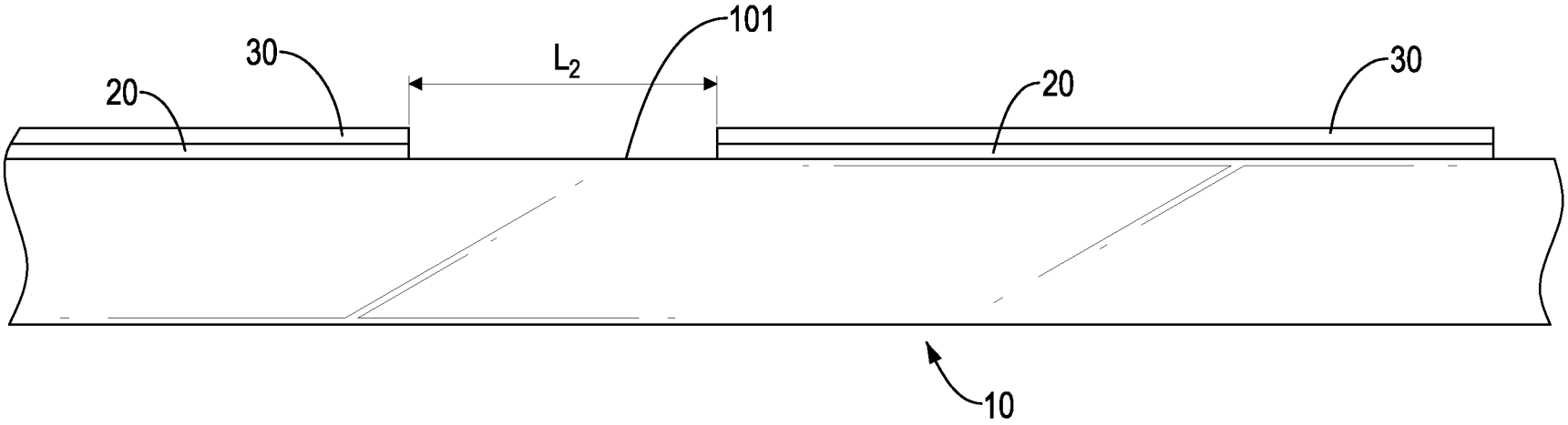
FIG. 3 is an enlarged operational side view of the printing step of the method for producing a multicolored aglet in FIG. 2.

A roll for producing multicolored aglets is further provided by the present invention. With reference to FIGS. 3 to 5, the roll for producing multicolored aglets comprises a plastic slice 10, multiple pattern layers 20, and multiple white background layers 30. The plastic slice 10 has a slice width W1. In the present invention, the plastic slice 10 is made of cellulose acetate; the slice width W1 may be 20 to 60 mm or 30 to 50 mm.

The multiple pattern layers 20 are printed on the plastic slice 10 with digital printing ink at spaced intervals of an interval length L2, and the pattern layers 20 may each have a respective pattern and a respective color. Each one of the multiple white background layers 30 is printed on and covers a respective one of the multiple pattern layers 20, so the pattern layers 20 are located between the plastic slice 10 and the white background layers 30.

At the time the user looks at the roll from a side where the plastic slice 10 is, he/she may see the patterns and colors of the multiple pattern layers 20 in good luminosity and color. Besides, the plastic slice 10 comprises the multiple mounting portions 101, being the uncovered areas on the plastic slice 10 between each two of the pattern layers 20. As a result, each one of the mounting portions 101 has a length, which is the interval length L2, and each one of the mounting portions 101 and an adjacent one of the pattern layers 20 have a total length, which is an aglet length L1.

Figure 6:
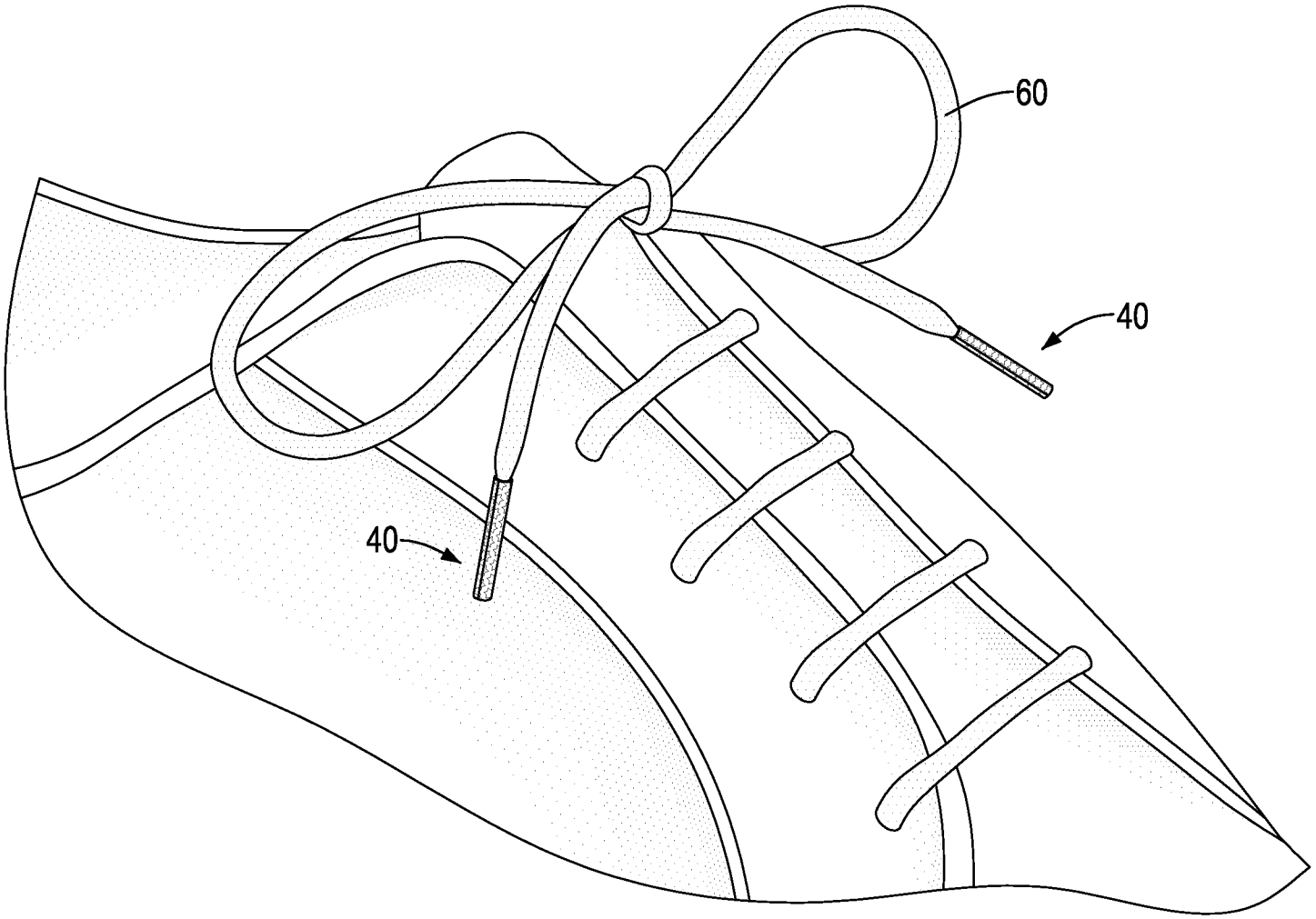
FIG. 6 is an operational perspective view of a multicolored aglet in accordance with the present invention.

With reference to FIGS. 6 to 8, a multicolored aglet in accordance with the present invention comprises two aglet bodies 40 that are respectively sheathed on two ends of a shoelace 60. Each one of the two aglet bodies 40 has a unit slice 10A, a pattern layer 20, and a white background layer 30.

The unit slice 10A is made of cellulose acetate, and has an outer side, an inner side, and a mounting portion 101. The mounting portion 101 has a length, which is an interval length L2.

The pattern layer 20 is printed on the inner side of the unit slice 10A with digital printing ink, along a lengthwise direction of the unit slice 10A. The mounting portion 101 is an area of the unit slice 10A that is not covered by the pattern layer 20. In addition, the mounting portion 101 covers and is fixed to the outer side of the unit slice 10A.

The white background layer 30 is printed on the pattern layer 20 with digital printing ink, and abuts the shoelace 60. Therefore, the pattern layer 20 is located between the unit slice 10A and the white background layer 30. Due to a white background provided by the white background layer 30, the user may see a pattern of the pattern layer 20 in its original colors, instead of being interfered by the color of the shoelace 60.

With the aforementioned technical characteristics, the multicolored aglet and the method for producing the same have the following advantages.

1. The processes are aided by computers throughout design, drawing, and printing. In comparison with the conventional screen printing, several days may be saved for preparation such as making the meshes.

2. For the same reason, a high quality customized and precise pattern may be easily printed under a lower price for producing the aglet bodies 40.

3. Quantity of the digital printing ink can be precisely utilized for printing the patterns, facilitating the advantage of eliminating the need to formulate new after the operating process is completed. Moreover, the present invention saves the amount solution for washing the meshes in the screen printing.

Thus, the present invention enables a more environment-friendly and resource-saving aglet and method for producing the same.

Figure 2:
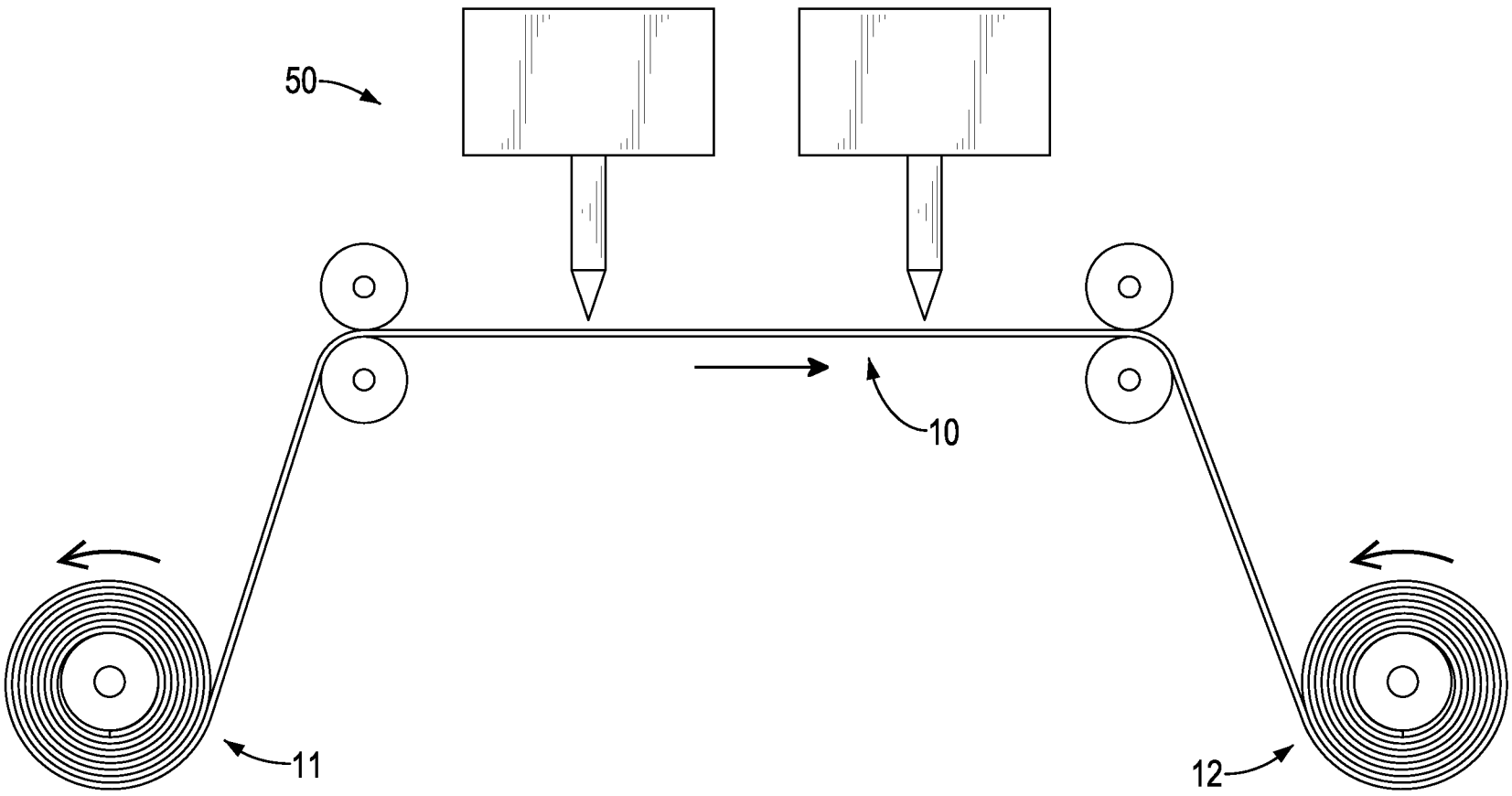
FIG. 2 is an operational side view of a printing step of the method for producing a multicolored aglet in FIG. 1.

4. As shown in FIG. 2, under the roll-to-roll operation, the plastic slice 10 is instantly rolled up as the post-printing roll 12 after the patterns are printed, which means that the present invention may be practiced in a limited space, in comparison with the space-consuming screen printing.

5. The pattern of the pattern layer 20 is prevented from dissolving due to an anti-soluble characteristic of the digital printing ink, and the pattern layer 20, the white background layer 30, and the solution to stick the mounting portion 101 are located on the different sides of the unit slice 10A.

6. The pattern of the pattern layer 20 is wrapped and thereby protected by the unit slice 10A, so accidental scratches to the pattern may be avoided.

Notwithstanding the numerous characteristics and advantages of the present invention set forth in the foregoing description, together with details of the structure and features of the invention, the disclosure is illustrative only and not intended to limit the scope of the claimed invention. Accordingly variations in the details, particularly with regard to shape, size, and arrangement of parts are included within the scope of the present invention to the full extent indicated by the broad general meaning of the terms as expressed in the appended claims.

What is claimed is:

1. A method for producing a multicolored aglet, the method comprising:

a plastic slitting step comprising slitting a transparent plastic material to obtain a plastic slice according to a set-up width;

a printing step comprising using digital printing ink to print multiple pattern layers on an inner side of the plastic slice at spaced intervals; and to print a respective white background layer on each one of the multiple pattern layers after printing the pattern layers; and an aglet forming step comprising cutting the plastic slice into multiple unit slices, so that each one of the multiple slices correspondingly has a respective one of the pattern layers and a respective one of the white background layers; and forming each one of the multiple unit slices into two aglet bodies that are respectively sheathed on two ends of a shoelace, wherein each unit slice has one said pattern layer and one said white background layer located between the unit slice and the shoelace.

2. The method for producing a multicolored aglet as claimed in claim 1, wherein in the printing step, the multiple pattern layers are printed at equal spaced intervals, so the plastic slice has multiple mounting portions that are respectively formed between each two of the multiple pattern layers;

in the aglet forming step, each one of the multiple unit slices has a respective one of the multiple mounting portions; and in the aglet forming step, the mounting portion of each one of the multiple unit slices is smeared with an organic solution, and is then stuck to an outer side of the unit slice.

3. A roll for producing a multicolored aglet, the roll comprising a plastic slice of a transparent material having an inner side;

multiple pattern layers printed on the inner side of the plastic slice at spaced intervals; and multiple white background layers, each one of the multiple white background layers is printed on a respective one of the multiple pattern layers;

wherein the multiple pattern layers and the multiple white background layers are printed with digital ink.

4. A multicolored aglet that is connected to a shoelace, the multicolored aglet comprising a unit slice of a transparent material formed into two aglet bodies that are sheathed on two ends of the shoelace, and the unit slice having a mounting portion stuck to an outer side of the unit slice;

a pattern layer printed on and covering an inner side of the unit slice excluding the mounting portion, and located between the unit slice and the shoelace; and a white background layer printed on the pattern layer and located between the pattern layer and the shoelace;

wherein the pattern layer and the white background layer are printed with digital ink.

* * * * *